United States Patent [19]

Espinosa

[11] Patent Number: 4,757,694

[45] Date of Patent: Jul. 19, 1988

[54] ENERGY SAVING ACCESSORY FOR AIR CONDITIONING UNITS

[76] Inventor: Ruben Espinosa, 151 NW. 17 Pl., Rear, Miami, Fla. 33125

[21] Appl. No.: 871,938

[22] Filed: Jun. 9, 1986

[51] Int. Cl.[4] ..... F25B 7/00

[52] U.S. Cl. ..... 62/175; 62/158; 62/182; 62/228.5

[58] Field of Search ..... 62/180, 182, 510, 175, 62/228.3, 228.5, 158; 236/1 EA

[56] References Cited

U.S. PATENT DOCUMENTS

| | | | |
|---|---|---|---|
| 2,091,563 | 8/1937 | Palmer | 62/182 X |
| 3,127,754 | 4/1964 | Mobarry | 62/158 |
| 3,422,633 | 1/1969 | Bodett | 62/158 |
| 3,434,028 | 3/1969 | McCready | 62/158 |
| 4,257,238 | 3/1981 | Kountz et al. | 62/180 X |
| 4,270,362 | 6/1981 | Lancia et al. | 62/182 X |
| 4,384,462 | 5/1983 | Overman et al. | 62/175 |
| 4,535,602 | 8/1985 | Alsenz | 62/175 |

OTHER PUBLICATIONS

Modern Refrigeration and Air Conditioning, Andrew D. Althouse, 1979, pp. 150, 151.

*Primary Examiner*—Harry Tanner

*Attorney, Agent, or Firm*—Jésus Sanchelima

[57] ABSTRACT

An accessory device for conventional refrigeration systems that include an auxiliary compressor of lower capacity piped in parallel with the compressor of the conventional system. The auxiliary compressor cuts in after a certain temperature is reached and automatically the speed of the fan is decreased to compensate for the lower capacity of the system. Time delays are incorporated to each of the compressors to allow the high and low pressure ports to equalize.

4 Claims, 1 Drawing Sheet

ENERGY SAVING ACCESSORY FOR AIR CONDITIONING UNITS

BACKGROUND OF THE INVENTION

1. Field of the Invention

The present invention relates to a cooling or refrigerating system having at least two compressors of different capacities and one evaporator, and more particularly, to such a system that regulates the air flow through the evaporator.

2. Description of the Related Art.

In a conventional cooling or refrigeration system, a compressor pumps a refrigerant gas under pressure to a condenser unit where heat is dissipated causing the refrigerant to liquify. After being passed through a thermostatic expansion valve or equivalent means, the refrigerant boils thereby absorbing heat (cooling) from the evaporator coils. Typically, a fan is positioned in front of the evaporator and cool air is blown to the area being cooled or refrigerated. As discussed in Modern Refrigeration and Air Conditioning, Althouse, A.D. et al, 1979 edition, pp. 150–151, the refrigerant enters the evaporator coils in liquid state and starts vaporizing as it progresses towards the low side of the evaporator. The best superheat setting for an evaporator is the point at which the temperature of the thermal bulb of the thermostatic expansion valve changes the least when the system is running. This setting is called the Minimum Stable Signal (MSS) point or setting. This setting is a result of the evaporator flow, the behavior of the expansion valve and the displacement of air passed through the cooling evaporator coils. The expansion valve is usually calibrated during the installation of the system. The flow characteristics and the air blown are usually constant. Therefore, for a one compressor system, an initial MSS setting is usually satisfactory until the components are worn out and the characteristics of the system change. However, when two compressors of different capacities are used, there may be considerable savings of energy by having a lower rating compressor 'cut in', as discussed in U.S. Pat. No. 4,535,602 issued to Alsenz in Aug. 20, 1985. But the superheat also moves away considerably from the MSS setting in the device disclosed by Alsenz. This changes the efficiency of the system. To solve this problem the present invention also regulates the amount of air blown through the evaporator coils. If less air is blown through the evaporator coils then less heat is absorbed and the lower capacity of the 'cut in' compressor is compensated urging the superheat setting back to the MSS setting. When the larger compressor 'cut in' then the speed of the evaporator fan is increased again.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that saves energy by having at least two compressors of different capacities cutting in depending on the load requirement while controlling the superheat setting by regulating the flow of air through the evaporator's cooling coils and urging the system to compensate the different characteristics of the compressors and bringing the superheat back towards the MSS setting.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

The figure represents a mechanical and electrical block and schematic diagram of a cooling system, showing the main compressor active.

DETAILED DESCRIPTION OF THE PREFERRED EMBODIMENT

Figure 1:
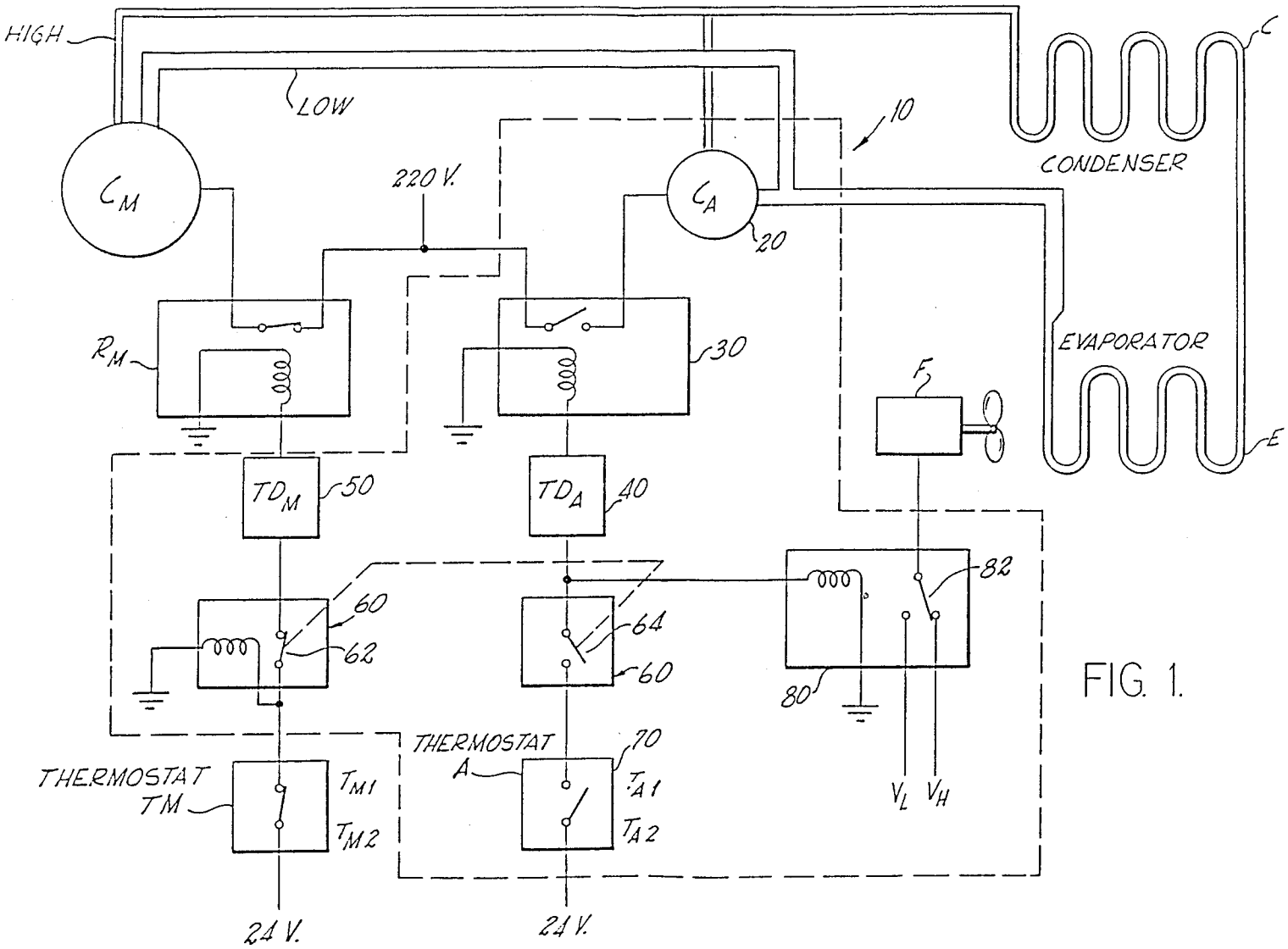

Referring now to the drawings where the present invention is generally referred to with numeral 10, it can be observed that it can be readily incorporated to work with a conventional air conditioning or refrigerating system with thermostat means $T_M$, compressor $C_M$, power relay means $R_M$, condenser C and evaporator E.

The present accessory device 10 basically comprises an auxiliary compressor 20, which is piped in parallel with main compressor $C_M$, power relay means 30 for auxiliary compressor 20, auxiliary time delay means 40, main time delay means 50, relay assembly with tandem switches 60, auxiliary thermostat means 70 and fan speed control means 80. Device 10 is connected in series between conventional thermostat $T_M$ and power relay means $R_M$ for main compressor $C_M$. Thermostat $T_M$ works as any conventional thermostat to activate the coil of relay means $R_M$ when the temperature sensed is higher than a predetermined temperature $T_{M2}$. When temperature $T_{M1}$ is reached, the 24 volts control voltage is interrupted, deactivating the coil of relay $R_M$ stopping compressor $C_M$. Therefore, $T_{M1}$ is lower than $T_{M2}$.

Device 10 connects main time delay means 50 and normally open switch means 62 of tandem relay assembly 60 in series between thermostat $T_M$ and the coil hot input of power relay $R_M$ so that when thermostat $T_M$ senses a temperature above $T_{M2}$ the 24 volts are applied to the coil of relay 60 causing switch means 62 to close. Main time delay means 50 allows the pressures in the low and high ports of conventional compressor $C_M$ to equalize before activating compressor $C_M$. After temperature $T_{M1}$ is reached, the 24 volts are interrupted, switch means 62 opens because the coil of relay means 60 is de-energized and compressor CM stops. At this time, switch means 64 in relay means 60 closes. The temperature setting for thermostat means 70 is such that the 24 volts control voltage is applied to switch means 64 when the temperature is above $T_{A2}$ which is set in the preferred embodiment to be equal to $T_{M1}$. $T_{A2}$, which is the temperature at which auxiliary compressor 20 cuts in is set at a temperature higher or equal to $T_{M1}$ and greater than $T_{M2}$. $T_{A1}$ is the temperature at which the auxiliary compressor stops, and may be set at $T_{M1}$ or lower since it will probably never reached the low temperature $T_{M1}$ but only try to maintain it. The idea being to select an auxiliary compressor 20 capacity sufficiently low to merely compensate for heat losses rather than having the capability of bringing the temperature down. This delays the time for the main compressor $C_M$ to cut in, thereby saving electricity. $T_{A1}$ should not be set too much higher than $T_{M1}$ because the lower capacity auxiliary compressor means 20 may not be able to overcome the heat loss in the system if it is allowed to build up. Auxiliary means 20 acts like an overdrive in an automobile, if an analogy is to be made. For example, if $T_{M1}$ is set to 70° F., $T_{M2}$ is 80° F., $T_{A1}$ may be 70° F. and $T_{A2}$ may be set to 75° F. then the system will use main compressor $C_M$ to bring the temperature down to $T_{M1}$ or 70° F. At that point, thermostat $T_M$ disconnects the 24 volt from the coil of relay 60, opens switch means 62 and closes switch means 64. Thermostat 70 is not activated because the temperature is lower than $T_{A2}$ or 75° F. The temperature starts rising and when it reaches 75° F., compressor 70 cut in. However, the action is not immediate because time delay means 40 will make it wait a sufficient amount of time to allow the pressures on the high and low side to equalize thereby reducing the initial load on the auxiliary compressor 20. Compressor 20 cuts in and having a capacity lower (preferably one-half) than compressor $C_M$ and it will try to maintain the temperature within the 70° F. to 75° F. by primarily overcoming the thermal leaks of the space being cooled or refrigerated. Of course, if the leaks are substantial or the ambient temperature outside is considerably higher, the temperature will increase to 80° F. which causes thermostat $T_M$ to close. This in turn activates the coil of relay means 60 thereby opening switching means 64 and closing switch means 62. Compressor $C_M$ is then activated after a sufficient time delay to, again, equalize the pressures.

This system saves energy because a high capacity compressor is used to lower the temperature to a point where a low capacity (consumes less energy) auxiliary compressor 20 takes over. However, the superheat characteristics of the system are affected and the MSS setting definitely disturbed. The present invention compensates this by changing the speed of the fan or blower used with the evaporator so that "starved" or "flooded" conditions are avoided as much as possible.

As it can be observed from FIG. 1, fan relay means 80 includes one-pole double throw switch means 82 that provide a selection of one of two voltages, $V_L$ and $V_H$ to variable speed fan member F. In this manner, when the 24 volts are transmitted through switch means 64 (compressor 70 is about to cut in after the required time delay) the coil of fan relay means 80 is energized causing the speed of fan F to change. Fan relay means 80, as illustrated, can only select between two voltages, and consequently, only two fan speeds are possible with the device disclosed here. But if more than one auxiliary compressors are used, then it is possible to have one fan speed for each compressor, or compressor combination, that will be proportional to its capacity or the capacity of the combination. A lower speed is used for a lower capacity rated compressor, or compressor combination, so that less heat is absorbed by the evaporator when less air is passed through. This tends to compensate the shift of the superheat setting away from the MSS point. The control signals activating the different compressors would be detected and a proportional voltage would be applied to a variable speed evaporator fan F. Therefore, if there are four possible compressor capacity combinations, then there would be four voltages available to fan F with four different speeds. The control apparatus disclosed in U.S. Pat. No. 4,535,602, which is hereby incorporated by reference, illustrates one manner of energizing different combinations of compressors of different capacities and the outputs of the capacity selector 10 in that U.S. patent may be used to provide a proportional voltage to the evaporator fan F, as discussed, to maintain the system as close to the MSS setting as possible.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. An accessory device to be used with electricity powered cooling systems having a first compressor means including first power relay means for interrupting the electrical power to said main compressor, condensor and evaporator assemblies, evaporator blower means, first thermostat means and a source for control voltage connected to said first thermostat means, comprising:

A. second compressor means of a capacity lower than the capacity of said first compressor means and having its high and low pressure ports piped in parallel to those of said first compressor;

B. second power relay means for interrupting the electric power supplied to said second compressor means and said second relay means including an energizing coil;

C. first time delay means having an input and an output and said output being connected to the coil of said first power relay means;

D. third relay means having an energizing coil and two switch means in tandem and each of said switch means having two connecting ends wherein one of said switch means is normally closed and the other switch means is normally open and normally open switch means having one of its connecting ends connected to said first thermostat means and said energizing coil of said third relay means being commonly connected to said one connecting end and to said first thermostat so that said normally open switch means closes when said first thermostat means senses a temperature higher than a first predetermined temperature and opens when a lower second predetermined temperature is sensed and the other connecting end of said normally open switch means being connected to the input of said first time delay means;

E. second thermostatic means including switch means having two connecting ends and one end being connected to said control voltage and the other end is connected to one end of said normally closed switch means so that when a third predetermined temperature is sensed by said second thermostatic means said switch means of said thermostatic means opens, and closes again when a fourth predetermined temperature is reached that is higher than said first predetermined temperature;

F. second time delay means having an input and an output and said output being connected to the energizing coil of said second power relay means and the input being connected to the other end of said normally closed switch means of said second relay means.

2. The device set forth in claim 1 further including:

G. speed control means for changing the speed of said evaporator blower having an energizing coil having an input connected to the end of said normally closed switch means that is connected to said first time delay means and said speed control means further including a voltage selector output connected to said evaporator blower means and so arranged and constructed that the voltage of said output decreases when said input of said speed control means detects said control voltage transmitted by said second thermostat means.

3. The device set forth in claim 2 wherein said speed control means includes a single pole double throw switch having two voltages available to said blower means so that said blower means may operate at one of two speeds.

4. The device set forth in claim 3 wherein said second and fourth predetermined temperatures are equal.

* * * * *